US007247403B2

(12) United States Patent
Brady et al.

(10) Patent No.: US 7,247,403 B2
(45) Date of Patent: Jul. 24, 2007

(54) SURFACE MODIFIED STAINLESS STEELS FOR PEM FUEL CELL BIPOLAR PLATES

(75) Inventors: Michael P. Brady, Oak Ridge, TN (US); Heli Wang, Littleton, CO (US); John A. Turner, Littleton, CO (US)

(73) Assignee: UT-Battelle, LLC, Oak Ridge, TN (US)

( * ) Notice: Subject to any disclaimer, the term of this patent is extended or adjusted under 35 U.S.C. 154(b) by 252 days.

(21) Appl. No.: 11/071,830

(22) Filed: Mar. 3, 2005

(65) Prior Publication Data

US 2005/0238873 A1 Oct. 27, 2005

Related U.S. Application Data

(60) Provisional application No. 60/563,923, filed on Apr. 21, 2004.

(51) Int. Cl.
*B32B 15/04* (2006.01)
*C23C 8/26* (2006.01)
*H01M 8/02* (2006.01)

(52) U.S. Cl. ..... 429/34; 148/230; 148/318; 428/472.1

(58) Field of Classification Search ..... None
See application file for complete search history.

(56) References Cited

U.S. PATENT DOCUMENTS 2,452,915 A * 11/1948 Feild ..... 148/230
2,851,387 A * 9/1958 Low ..... 148/230
3,647,572 A * 3/1972 Todd et al. ..... 148/220
3,885,995 A 5/1975 Cunningham et al.
4,334,938 A * 6/1982 Shay et al. ..... 148/500
5,013,371 A * 5/1991 Tahara et al. ..... 148/231

(Continued)

FOREIGN PATENT DOCUMENTS

JP 59-047379 * 3/1984

(Continued)

OTHER PUBLICATIONS

Allegheny Ludlum, Technical Data Blue Sheet, AL20 Alloy, pp. 1-6, 1998.

(Continued)

*Primary Examiner*—John J. Zimmerman
(74) *Attorney, Agent, or Firm*—Quarles & Brady LLP

(57) ABSTRACT

A nitridation treated stainless steel article (such as a bipolar plate for a proton exchange membrane fuel cell) having lower interfacial contact electrical resistance and better corrosion resistance than an untreated stainless steel article is disclosed. The treated stainless steel article has a surface layer including nitrogen-modified chromium-base oxide and precipitates of chromium nitride formed during nitridation wherein oxygen is present in the surface layer at a greater concentration than nitrogen. The surface layer may further include precipitates of titanium nitride and/or aluminum oxide. The surface layer in the treated article is chemically heterogeneous surface rather than a uniform or semi-uniform surface layer exclusively rich in chromium, titanium or aluminum. The precipitates of titanium nitride and/or aluminum oxide are formed by the nitriding treatment wherein titanium and/or aluminum in the stainless steel are segregated to the surface layer in forms that exhibit a low contact resistance and good corrosion resistance.

42 Claims, 10 Drawing Sheets

U.S. PATENT DOCUMENTS

| | | | | | |
|---|---|---|---|---|---|
| 5,114,500 | A | * | 5/1992 | Tahara et al. | 148/230 |
| 5,372,655 | A | | 12/1994 | Preisser et al. | |
| 5,376,188 | A | * | 12/1994 | Tahara et al. | 148/230 |
| 5,403,409 | A | | 4/1995 | Tahara et al. | |
| 5,599,404 | A | | 2/1997 | Alger | |
| 5,624,769 | A | * | 4/1997 | Li et al. | 429/32 |
| 5,653,822 | A | | 8/1997 | Stickels et al. | |
| 5,683,828 | A | | 11/1997 | Spear et al. | |
| 5,798,188 | A | | 8/1998 | Mukohyama et al. | |
| 5,985,048 | A | | 11/1999 | Wahlert et al. | |
| 6,090,223 | A | | 7/2000 | Kiuchi et al. | |
| 6,725,911 | B2 | | 4/2004 | Jayaweera et al. | |
| 2003/0190515 | A1 | | 10/2003 | Brady et al. | |
| 2004/0048134 | A1 | * | 3/2004 | Kihira et al. | 429/34 |
| 2006/0040165 | A1 | * | 2/2006 | Uchiyama et al. | 429/34 |

FOREIGN PATENT DOCUMENTS

| | | | |
|---|---|---|---|
| JP | 04-311559 | * | 11/1992 |
| JP | 2003-123783 | * | 4/2003 |
| JP | 2005-293982 | * | 10/2005 |

OTHER PUBLICATIONS

Allegheny Ludlum, Technical Data Blue Sheet, AL29-4C Alloy, pp. 1-6, 1998.

* cited by examiner (a)

(b)

SURFACE MODIFIED STAINLESS STEELS FOR PEM FUEL CELL BIPOLAR PLATES

CROSS-REFERENCES TO RELATED APPLICATIONS

This application claims priority from U.S. Provisional Patent Application No. 60/563,923, filed Apr. 21, 2004.

STATEMENT REGARDING FEDERALLY SPONSORED RESEARCH

This invention was made with Government support under Contract No. DE-AC05-00OR22725 awarded to UT-Battelle, LLC, by the U.S. Department of Energy. The Government has certain rights in this invention.

BACKGROUND OF THE INVENTION

1. Field of the Invention

This invention relates to a nitridation surface treatment that modifies the passive oxide layer on stainless steel alloys such that the interfacial contact electrical resistance is decreased and the corrosion resistance is improved. Stainless steel alloys processed according to the invention are useful in electrochemical energy conversion devices that require low interfacial contact electrical resistance and good corrosion resistance such as bipolar plates used in proton exchange membrane fuel cells.

2. Description of the Related Art

A major impediment to widespread commercialization of fuel cell technology is cost. One of the most expensive components in proton exchange membrane fuel cells (PEMFCs) are the bipolar plates, which serve to electrically connect the anode of one cell to the cathode of the next into a stack to achieve a useful voltage. They also separate and distribute reactant and product streams; to accomplish this, flow-field grooves are manufactured into the faces of the plates. Solid graphite is often used for bipolar plates, but is brittle and expensive to machine. Polymer/carbon fiber and carbon or graphite composite bipolar plates have shown promise; however, issues remain regarding their amenability to high-volume manufacturing techniques, performance, and the power densities achievable. U.S. Pat. No. 5,798,188 shows another type of bipolar plate in which a coating comprising metal, metal nitride or metal carbide is disposed on the surfaces of a polymer substrate.

Metallic alloys (e.g. stainless steels) would be ideal as bipolar plates because they are amenable to low-cost/high-volume manufacturing, offer high bulk thermal and electrical conductivities, and can be made in thin sheet or foil form (0.1-1 mm. thick) to achieve high power densities. However, the inadequate corrosion behavior of most metals in PEMFC environments has prevented their use. The key issues are passivation resulting in unacceptably high interfacial contact electrical resistance and dissolution of metallic ions, both of which can significantly degrade fuel cell performance.

There have been solutions proposed to the problem of unacceptably high interfacial contact electrical resistance in bipolar plates. For example, U.S. Pat. No. 6,379,476 describes a stainless steel product for producing a polymer electrode fuel cell in which discrete carbide/boride particles are added to the stainless steel such that the particles extend beyond the passive layer to lower contact resistance.

There has also recently been developed a nitridation treatment that forms a dense, continuous surface layer of $CrN/Cr_2N$ layers on Ni—Cr and related alloys. U.S. patent application Ser. No. 2003/0190515 discloses a corrosion resistant, electrically conductive component, such as a bipolar plate for a PEM fuel cell, that includes 20-55% chromium and balance base metal such as nickel, iron, or cobalt. The component has thereon a substantially external, continuous layer of chromium nitride. This continuous layer is typically on the order of 3-5 microns thick and behaves very well in PEMFC environments. These thermally grown Cr nitrides ($CrN/Cr_2N$) on a Cr-bearing alloy, Ni-50Cr (wt %), show great promise in PEMFC bipolar plate environments. However, this alloy may be too expensive for certain PEMFC applications.

Thus, work has been undertaken to form similar nitride surface layers (as described in U.S. patent application Ser. No. 2003/0190515) on inexpensive, commercially available alloys. Similar thermal nitridation conditions have been applied to a relatively inexpensive, commercially available austenitic stainless steel sold under the designation 349. A discontinuous discrete mixture of CrN, $Cr_2N$ and $(Cr,Fe)_2N_{1-x}$ (x=0 to 0.5) phase surface particles overlying an exposed austenite based matrix, rather than a continuous nitride surface layer, was formed. This resulted in unacceptably high corrosion rates under simulated PEMFC anodic and cathodic conditions. It is believed that many commercial stainless steels are degraded by the current nitridation conditions because they precipitate discrete internal Cr-nitride particles.

Therefore, there is still a need for metallic alloys, such as stainless steels, that can be used in PEMFC bipolar plates and that exhibit adequate corrosion resistance and acceptably low interfacial contact electrical resistance.

SUMMARY OF THE INVENTION

The foregoing needs are met by the present invention which provides a nitridation surface treatment that modifies the passive oxide layer on stainless steel alloys such that the interfacial contact electrical resistance is decreased (e.g., by an order of magnitude) and the corrosion resistance is improved. The process of the invention may be applied to inexpensive existing commercially available stainless steel alloys.

In one aspect, the invention provides an article including stainless steel having a surface layer including nitrogen-modified chromium-base oxide and precipitates of chromium nitride wherein oxygen is present in the surface layer at a greater concentration than nitrogen. In one form, the surface layer further includes precipitates of titanium nitride, and the nitrogen-modified chromium-base oxide is present in the surface layer at a greater concentration than the precipitates of chromium nitride and the precipitates of titanium nitride combined. In another form, the surface layer further includes precipitates of aluminum oxide, and the nitrogen-modified chromium-base oxide and the precipitates of aluminum oxide are present in the surface layer at a greater concentration than the precipitates of chromium nitride and the precipitates of titanium nitride combined. In yet another form, the surface layer further includes precipitates of a transition metal nitride. The surface layer may be a chemically heterogeneous surface and not a uniform or semi-uniform surface layer exclusively rich in chromium.

The stainless steel may include titanium at a level of 1 weight percent or less based on the total weight of the stainless steel. The stainless steel may be a ferritic stainless steel that includes nickel at a level of less than 5 weight percent based on the total weight of the stainless steel. Alternatively, the stainless steel may be an austenitic stainless steel including greater than 20 weight percent nickel based on the total weight of the stainless steel.

In another aspect, the invention provides a process for increasing the corrosion resistance and decreasing the interfacial contact electrical resistance of a stainless steel article. The process includes the steps of (a) providing an article comprising stainless steel having a surface layer including chromium-base oxide; (b) exposing the surface layer to an atmosphere comprising nitrogen without prior removal of the surface layer to introduce nitrogen into the chromium-base oxide and to form precipitates of chromium nitride in the surface layer; and (c) ceasing exposure of the surface layer to the atmosphere before the volume of precipitates of chromium nitride degrades the corrosion resistance. Preferably, the atmosphere is nitrogen or a nitrogen-hydrogen mixture. Most preferably, the atmosphere is minimized from oxygen and oxygen impurities.

In one version of the process, step (c) may involve ceasing exposure of the surface layer to the atmosphere when nitrogen uptake for the surface layer exceeds 1 $mg/cm^2$. In another version of the process, step (c) may involve ceasing exposure of the surface layer to the atmosphere when nitrogen uptake for the surface layer is in the range of 0.05 $mg/cm^2$ to 0.75 $mg/cm^2$. In yet another version of the process, step (c) may involve ceasing exposure of the surface layer to the atmosphere when nitrogen uptake for the surface layer is in the range of 0.25 $mg/cm^2$ to 0.5 $mg/cm^2$. Preferably, the nitrogen modified chromium-base oxide is present in the surface layer at a greater concentration than the precipitates of chromium nitride in the surface layer after ceasing exposure of the surface layer to the atmosphere.

Stainless steel alloys processed in accordance with the invention are useful in electrochemical energy conversion devices that require low interfacial contact electrical resistance and good corrosion resistance, such as the bipolar plates used in proton exchange membrane fuel cells or sensors. The use of stainless steel alloys processed in accordance with the invention in bipolar plates would be particularly advantageous in that there would be a significant decease in stack cost over graphite materials as stainless steel alloys are amenable to high volume manufacturing such as stamping. Also the use of stainless steel alloys in the bipolar plates would result in higher power densities than graphite and carbon composite materials because the superior mechanical properties of stainless steel alloys allow for thinner plates. Also, enhanced corrosion resistance would be achieved without sacrificing electrical conductance.

These and other features, aspects, and advantages of the present invention will become better understood upon consideration of the following detailed description, drawings, and appended claims.

BRIEF DESCRIPTION OF THE DRAWINGS

In FIG. 1(*a*), the sample was polarized at 0.6 V and the solution was purged with air. In FIG. 1(*b*), the sample was polarized at −0.1 V and the solution was purged with hydrogen gas.

In FIG. 2(*a*), the sample was exposed in a simulated PEMFC cathode environment. In FIG. 2(*b*), the sample was exposed in a simulated PEMFC anode environment.

In FIG. 4(*a*), the sample was polarized at 0.6 V and the solution was purged with air. In FIG. 4(*b*), the sample was polarized at −0.1 V and the solution was purged $H_2$ gas.

DETAILED DESCRIPTION OF THE INVENTION

Figure 1:
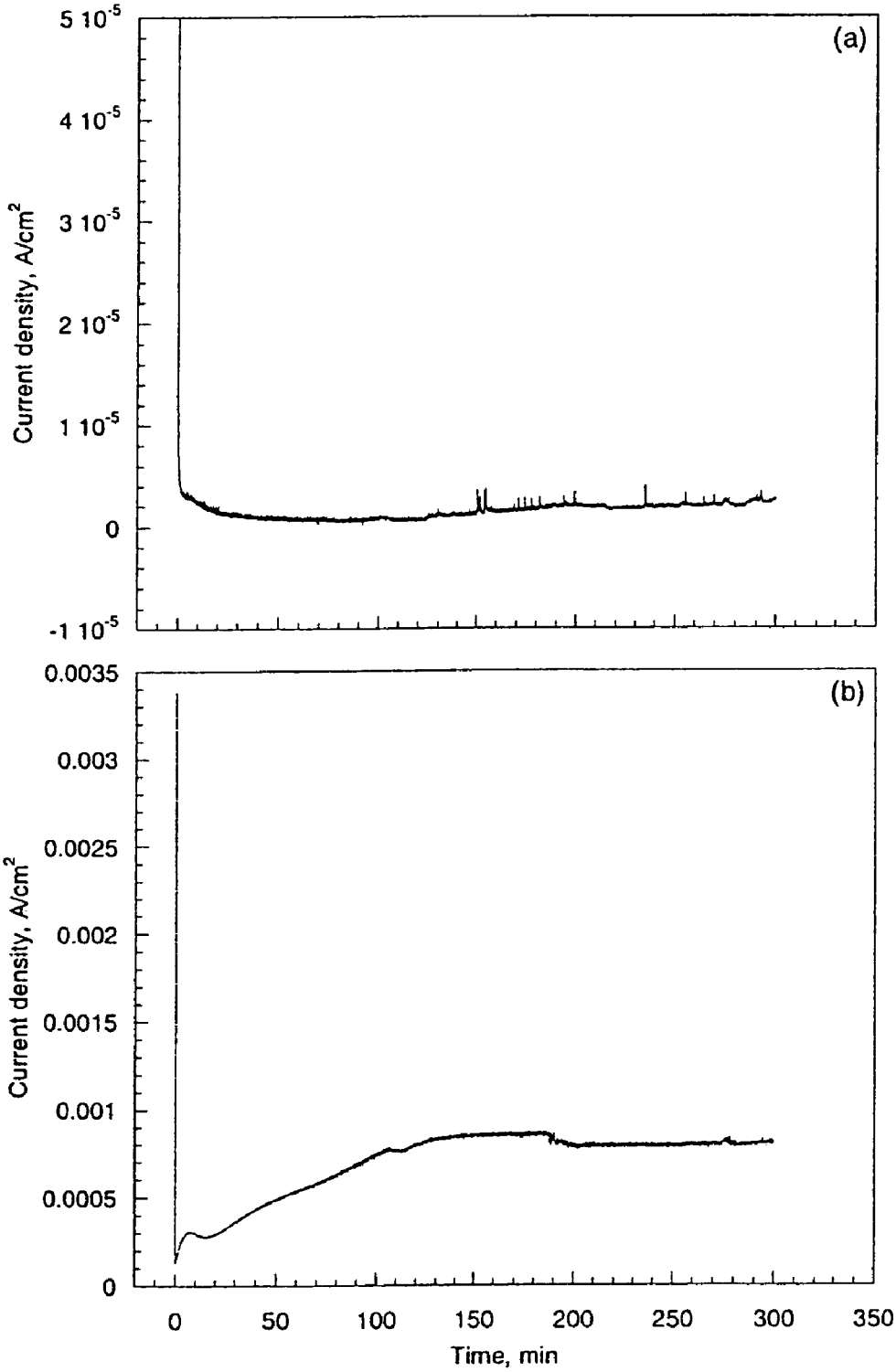
FIG. 1 includes graphs showing transient currents of 24 hour nitrided AISI446 stainless steel in simulated PEMFC environments.

In one aspect of the invention, there is provided a nitridation treated stainless steel article having lower interfacial contact electrical resistance and better corrosion resistance than an untreated stainless steel article. (By stainless steel, we mean an alloy steel having 9 weight percent or more chromium.) The nitridation surface treatment modifies the passive oxide layer on the stainless steel. The treated article includes stainless steel having an external passive surface layer including nitrogen-modified chromium-base oxide and precipitates of chromium nitride, wherein oxygen is present in the surface layer at a greater concentration than nitrogen. The precipitates of chromium nitride are formed in the surface layer by the nitriding treatment. Preferably, the surface layer is 1 micron thick or less, and most preferably, the surface layer is 100 nanometers thick or less.

The surface layer may further include precipitates of titanium nitride, where the nitrogen-modified chromium-base oxide is present in the surface layer at a greater concentration than the precipitates of chromium nitride and the precipitates of titanium nitride combined. The precipitates of titanium nitride are formed in the surface layer by the nitriding treatment wherein alloying additions of titanium in the stainless steel are segregated to the surface layer in forms that exhibit a low interfacial electrical contact resistance and good corrosion resistance.

The surface layer may further include precipitates of aluminum oxide, where the nitrogen-modified chromium-base oxide and the precipitates of aluminum oxide are present in the surface layer at a greater concentration than the precipitates of chromium nitride and the precipitates of titanium nitride combined. The precipitates of aluminum oxide are formed in the surface layer by the nitriding treatment wherein alloying additions of aluminum in the stainless steel are segregated to the surface layer in forms that exhibit a low electrical contact resistance and good corrosion resistance.

The surface layer may further include precipitates of a transition metal nitride. For example, precipitates of tantalum nitride may also form upon segregation of alloying additions of tantalum.

Nitridation is generally conducted at a temperature in the range of 800° C. to 1200° C. in pure nitrogen or 96% nitrogen-4% hydrogen mixtures, although a temperature as low as 400° C. in ammonia environments is also suitable. For nitridation, resultant nitrogen levels in the range of 0.1-1 $mg/cm^2$ are the general target to minimize the chances for internal nitride precipitation. There is no need to remove the passive oxide layer of the stainless steel before nitridation.

The surface treatment can also be accomplished by plasma assisted and related processes well established in the art, which permit lower temperature nitridation. External nitride formation can also be favored by use of a gaseous atmosphere with a reduced nitrogen partial pressure. Such conditions are well known to favor external nitridation reactions over discontinuous internal nitridation due to the corresponding decrease in alloy nitrogen solubility and inward nitrogen flux. Such a method can also be used to eliminate formation of less stable base metal nitrides.

External chromium-nitride formation can also be accomplished by first forming a chromium-base oxide layer, which enriches the surface with chromium, and subsequently converting the chromium-oxides to chromium-nitride by a nitridation method particularly using ammonia or other nitrogen-hydrogen mixtures. This is particularly beneficial because the critical chromium concentration to form an external layer is much lower for oxidation than nitridation in most alloys.

In one example embodiment, a nitridation surface treatment at 1100° C. for 2 hours at 1 atmosphere pure nitrogen with a nitrogen uptake on the order of 0.5 $mg/cm^2$ is used to modify the passive oxide layer on a 400 series stainless steel alloy including titanium such as a stainless steel having 0.02 C, 27 Cr, 3.7 Mo, 2 Ni, 0.37 Mn, 0.4 Si, 0.47 Ti, 0.03 Nb, 0.1 V, 0.1 Cu, 0.06 Co, 0.06 Al, 0.012 P, 0.0253 N, 0.001 S, 0.0025 O, balance Fe (weight %). Among other things, this alloy comprises chromium at a level of greater than 20 weight percent based on the total weight of the stainless steel, nickel at a level of less than 5 weight percent based on the total weight of the stainless steel, is ferritic, comprises titanium at a level of 1 weight percent or less based on the total weight of the stainless steel, and comprises aluminum at a level of 1 weight percent or less based on the total weight of the stainless steel. A chemically heterogeneous surface layer is formed rather than a uniform or semi-uniform surface layer exclusively rich in aluminum, titanium, or chromium.

In another example embodiment, a nitridation surface treatment at 1100° C. for 2 hours at 1 atmosphere pure nitrogen with a nitrogen uptake on the order of 0.5 $mg/cm^2$ is used to modify the passive oxide layer on an austenitic stainless steel alloy including tantalum such as a stainless steel having a typical chemical composition in weight percent as follows: Carbon 0.02; Manganese 0.40; Phosphorus 0.025; Sulfur 0.002; Silicon 0.40; Nickel 33.00; Chromium 19.50; Molybdenum 2.15; Copper 3.20; Columbium+Tantalum 0.40; and Iron Balance. Among other things, this alloy comprises nickel at a level of greater than 20 weight percent based on the total weight of the stainless steel, is austenitic, and comprises tantalum at a level of 1 weight percent or less based on the total weight of the stainless steel.

In yet another example embodiment, a nitridation surface treatment at 1100° C. for 2 hours at 1 atmosphere pure nitrogen with a nitrogen uptake on the order of 0.5 $mg/cm^2$ is used to modify the passive oxide layer on a ferritic stainless steel alloy including titanium such as a stainless steel having a typical chemical composition in weight percent as follows: Carbon 0.02; Manganese 0.50; Phosphorus 0.03; Sulfur<0.01; Silicon 0.35; Chromium 29; Nickel 0.30; Molybdenum 4; Nitrogen 0.02; Titanium+Columbium (Niobium) 0.6; and Iron Balance. Among other things, this alloy comprises nickel at a level of less than 5 weight percent based on the total weight of the stainless steel, is ferritic, and comprises titanium at a level of 1 weight percent or less based on the total weight of the stainless steel.

The treated stainless steel according to the invention is particularly advantageous when used as a bipolar plate of a proton exchange membrane fuel cell as the stainless steel has lower interfacial electrical contact resistance and better corrosion resistance than an untreated stainless steel.

EXAMPLES

The following Examples have been presented in order to further illustrate the invention and are not intended to limit the invention in any way.

1. Experimental

1.1 Material

Stainless steel plates were obtained from J&L Specialty Steel, Inc. The nominal composition is: 0.03 C, 28.37 Cr, 3.50 Mo, 2.96 Ni, 0.43 Mn, 0.42 Si, 0.75 Ti+Nb (weight %) with Fe as the reminder. This composition is representative of the mod-1 variation of AISI446 (UNS S44660). It should be noted that AISI446 mod-1 is referred to herein as AISI446 for convenience. The analyzed composition of this alloy by inductively coupled plasma (ICP) and gas fusion was 0.02 C, 27 Cr, 3.7 Mo, 2 Ni, 0.37 Mn, 0.4 Si, 0.47 Ti, 0.03 Nb, 0.1 V, 0.1 Cu, 0.06 Co, 0.06 Al, 0.012 P, 0.0253 N, 0.001 S, 0.0025 O, balance Fe (weight %). Alloy plates were cut into samples of 2.54 cm.×1.27 cm. (1.0×0.5 inches). The samples were ground through #600 grit SiC abrasive paper, rinsed with acetone and dried with nitrogen gas.

Thermal nitridation was carried out in a high vacuum alumina furnace that was backfilled with pure nitrogen to 1 atmosphere, the nitrogen flow stopped, and then the furnace was heated to 1100° C. The baseline 2 hour, 1100° C. nitridation treatment developed for a model Ni-50Cr alloy (see Brady, et al., Electrochemical and Solid-State Letters, 5 (2002), A245-A247) resulted in nitrogen uptake on the order of only 0.5 $mg/cm^2$ for the AISI446, and the sample appeared tinted (indicative of a very thin surface layer) rather than the usual opaque gray appearance associated with a thick (micron range) nitride surface layer. Therefore, an additional nitridation treatment with a hold time of 24 hours at 1100° C. was also examined. This resulted in nitrogen uptake on the order of 4-5 $mg/cm^2$ and the more typical uniform gray appearance.

1.2 Characterization

The thermally nitrided AISI446 was characterized by scanning electron microscopy (SEM), glancing angle x-ray diffraction (XRD), Auger electron spectroscopy (AES), X-ray Photoelectron Spectroscopy (XPS), and cross section transmission electron microscopy (TEM) using focused ion beam milling for specimen preparation. Polarization studies were conducted under simulated aggressive PEMFC environments using 1 M $H_2S0_4$+2 ppm $F^-$ solution at 70° C. sparged either with air (PEMFC cathodic conditions) or with hydrogen gas (PEMFC anodic conditions). The potentials reported are relative to the standard calomel electrode (SCE) unless otherwise noted. Interfacial contact resistance (ICR) measurements were carried out at room temperature with metallic, as-nitrided, and polarized AISI446 samples. Details for the ICR measurements can be found at Wang et al., *J. Power Sources* 115 (2), (2003) 243. For the polarized AISI446 sample, potentiostatic polarization was conducted only on one face of the sample. ICR data for these samples is presented as a sum of both faces, polarized and as-nitrided.

2. Results and Discussion

2.1 The 24 Hour Nitrided AISI446

Potentiostatic polarization measurements for 24 hour nitrided AISI446 in 1 M $H_2SO_4$+2 ppm $F^-$ at 70° C. are shown in FIG. 1 for 0.6V in air sparged solution (cathodic simulation, FIG. 1*a*) and for −0.1 V in hydrogen gas sparged solution (anodic simulation, FIG. 1*b*). Low current densities were observed under the simulated cathodic conditions, on the order of ca. $2\times10^{-6}$ A/cm$^2$. However, under the simulated anodic conditions, high current densities were obtained, which stabilized at ca. $0.8\times10^{-3}$ A/cm$^2$ over the course of a 5 hour hold. Current densities on the order of $10^{-6}$ A/cm$^2$ are considered sufficiently promising to move forward to fuel cell testing. The high current densities indicate that the 24 hour nitrided-material is not promising for PEMFC bipolar plate application.

Figure 2:
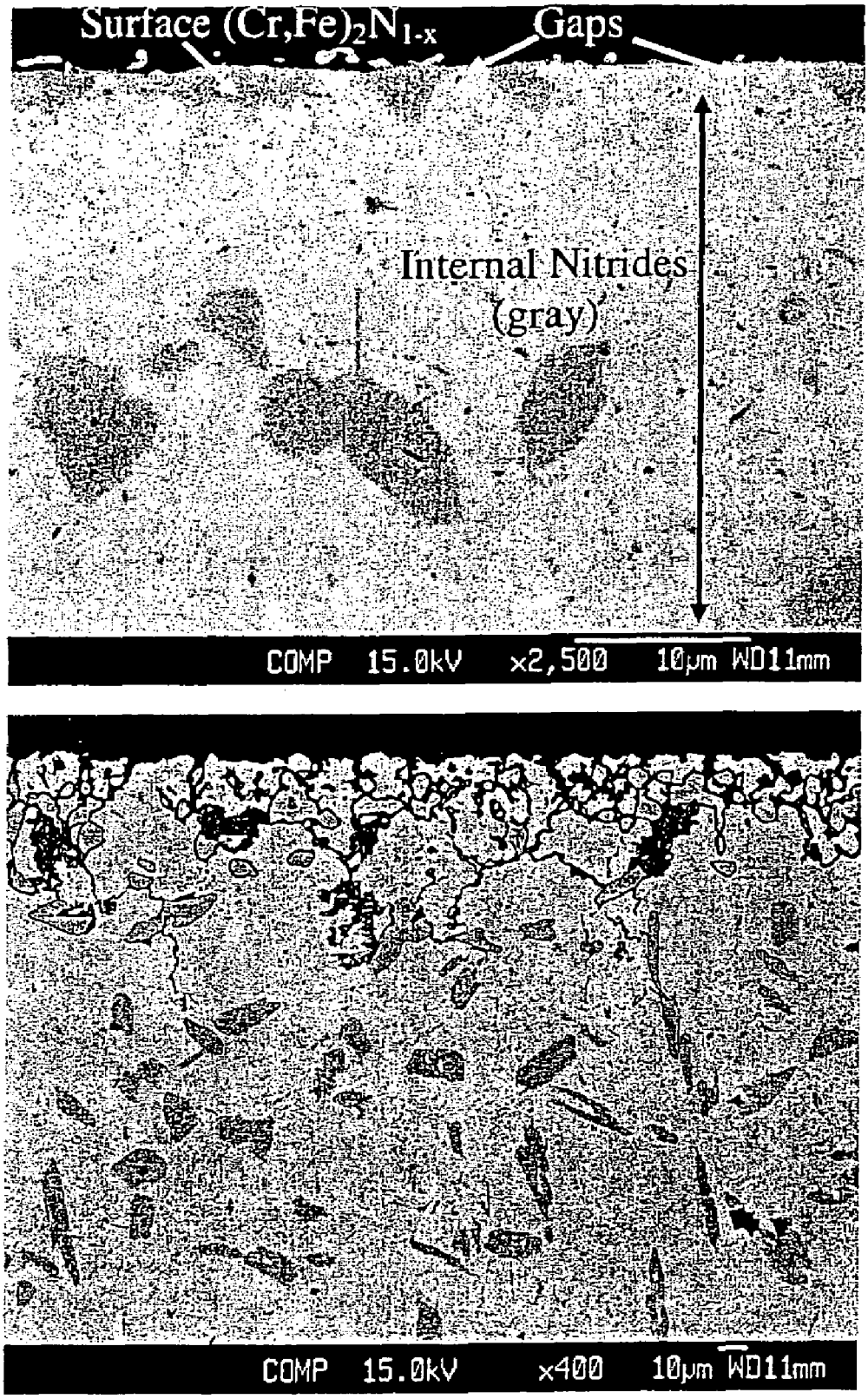
FIG. 2 includes photographs showing a SEM cross-section of 24 hour nitrided AISI446 steels.

SEM cross-sections of the polarized samples are shown in FIG. 2. The sample exposed in PEMFC cathode environment (FIG. 2*a*) showed a similar microstructure to as-nitrided AISI446 material, and consisted of an inward growing Cr-rich nitride scale overlying an extensive zone of internal Cr-rich nitrides. XRD and EDS data indicate that the Cr-rich nitride external and internal phases were consistent with the $(Cr,Fe)_2N_{1-x}$ (x=0 to 0.5) phase rather than with $Cr_2N$ (although trace quantities of CrN were also detected). This microstructure is in contrast to that observed for nitrided 349 stainless steel, which showed isolated, loosely adherent discrete $Cr_2N/(Cr,Fe)_2N_{1-x}$ (x=0 to 0.5) based surface particles. However, unlike the inward growing $Cr_2N$ layer formed on nitrided Ni-50Cr (as described in U.S. patent application No. 2003/0190515), the $(Cr,Fe)_2N_{1-x}$ (x=0 to 0.5) layer formed on 24 hour nitrided AISI446 was not continuous. It is interesting to note that this lack of continuity did not result in poor corrosion resistance under the simulated cathodic test conditions, but did result in very poor corrosion resistance under the simulated anodic conditions.

The microstructure of 24 hour nitrided AISI446 after the simulated PEMFC anodic conditions is shown in FIG. 2*b*. Extensive dissolution and attack was evident at and along the $(Cr,Fe)_2N_{1-x}$/alloy interfaces, suggestive of a local galvanic couple effect. It is speculated that oxygen, which is available under cathodic conditions, allowed for local passivation and protection of the surface in these regions. However, under the hydrogen purged anodic conditions, oxygen was not sufficiently available, or more likely, the mechanism of formation sufficiently altered, that a protective passive layer could not be locally established in the gap regions of $(Cr,Fe)_2N_{1-x}$ coverage.

2.2 The 2 Hour Nitrided 446

Figure 3:
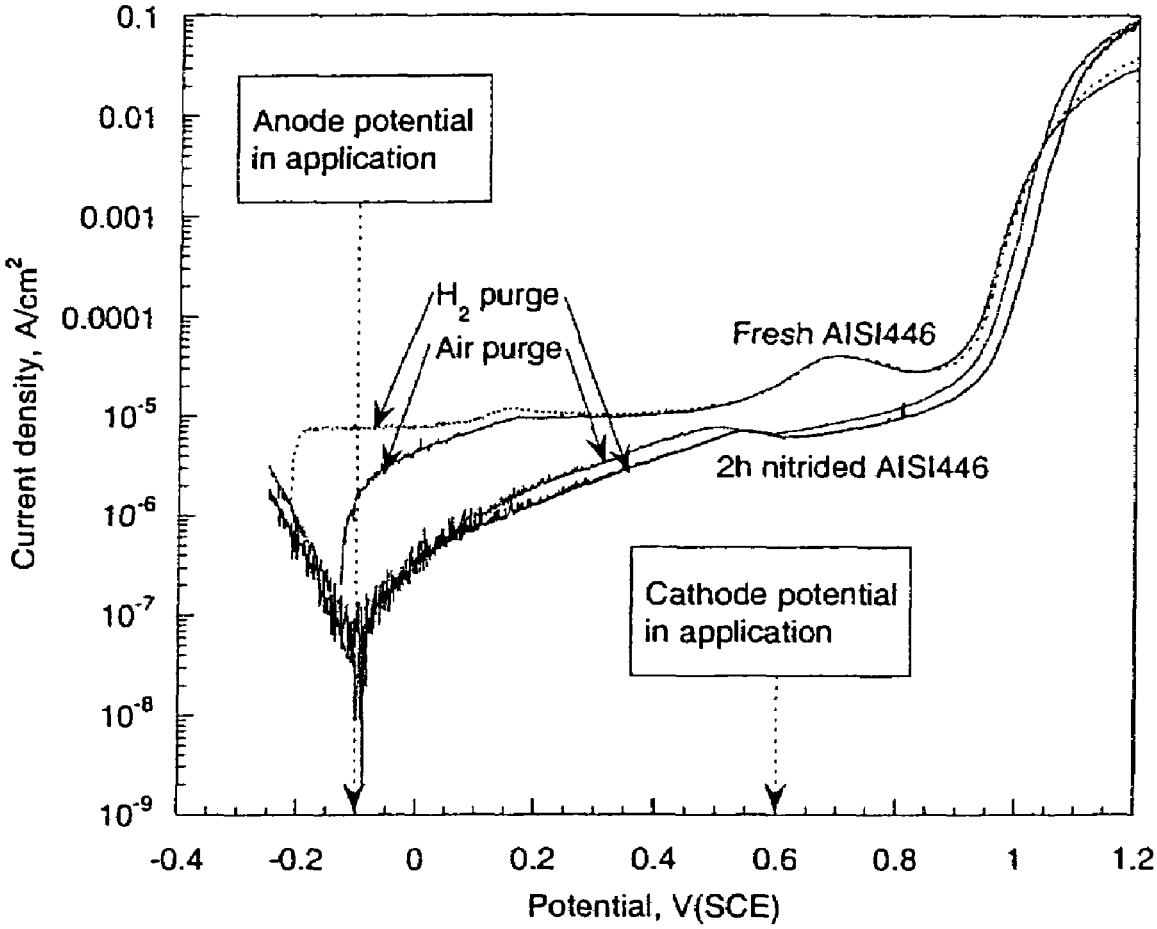
FIG. 3 is a graph showing dynamic polarization behavior of 2 hour nitrided AISI446 stainless steel in 1 M $H_2SO_4$+2 ppm $F^-$ at 70° C. purged either with air or hydrogen gas. The anode and cathode potentials in PEMFC application are marked. Polarization curves with untreated (fresh) AISI446 are plotted for comparison.

Dynamic polarization of 2 hour nitrided AISI446 steel in 1 M $H_2SO_4$+2 ppm $F^-$ at 70° C. in air and hydrogen gas sparged solutions is shown in FIG. 3. The polarization curves are almost identical, indicating a minimal effect of the sparging gas. Polarization curves with fresh AISI446 steels in the same environments are plotted for comparison. With fresh AISI446 samples, the sparging gases have significant influence in the corrosion potential and the anodic polarization up to 0.2 V. At 0.2 V and above, their effect is negligible. With 2 hour nitridation, the OCP shifts anodically. The corrosion potential of the 2 hour nitrided 446 was at ca. −0.09 V in hydrogen-sparged solution and at ca. −0.1 V in air sparged one. This is very close to the expected anodic operating conditions in PEMFC's of −0.1 V, and could make it susceptible to dissolution. The changes in corrosion potential reflect that the surface condition of the 2 hour nitrided AISI446 steel is clearly different from that of the fresh steel. Also noted is that the broad current peak at ca. 0.7 V with fresh AISI446 seems shifting cathodically to ca. 0.5-0.55 V. Overall, compared to the fresh steel, the current densities of the 2 hour nitrided AISI446 are reduced over the potential range of interest, indicating a moderate improvement in the corrosion resistance resulting from thermal nitridation.

Figure 4:
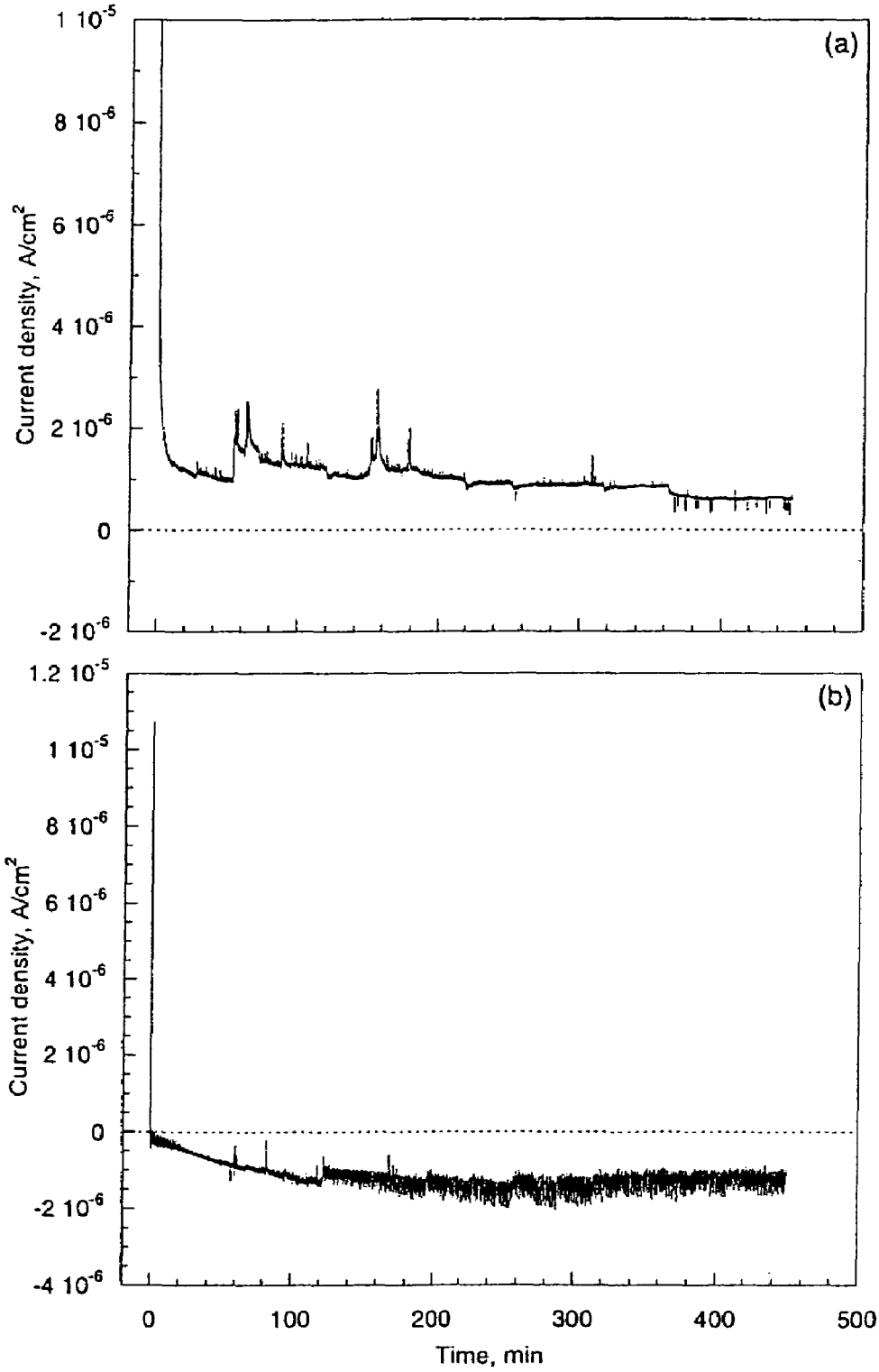
FIG. 4 includes graphs showing transient currents of 2 hour nitrided 446 stainless steel in a simulated PEMFC environment.

Potentiostatic polarization measurements for 2 hour nitrided AISI446 in 1 M $H_2SO_4$+2 ppm $F^-$ at 70° C. are shown in FIG. 4 for 0.6V in air-sparged solution (cathodic simulation, FIG. 4*a*) and −0.1 V in hydrogen sparged solution (anodic simulation, FIG. 4*b*). In the simulated cathodic environment, the corrosion current density quickly stabilized to ca. $0.6\times10^{-6}$ A/cm$^2$. The corrosion current density stabilized on the order of $-1\times10^{-6}$ A/cm$^2$ under the simulated anodic conditions, with the sign of the current suggesting a protection rather than anodic dissolution. These current densities were comparable to the untreated AISI446 in this environment, and are sufficiently low to indicate promise for PEMFC applications.

Figure 5:
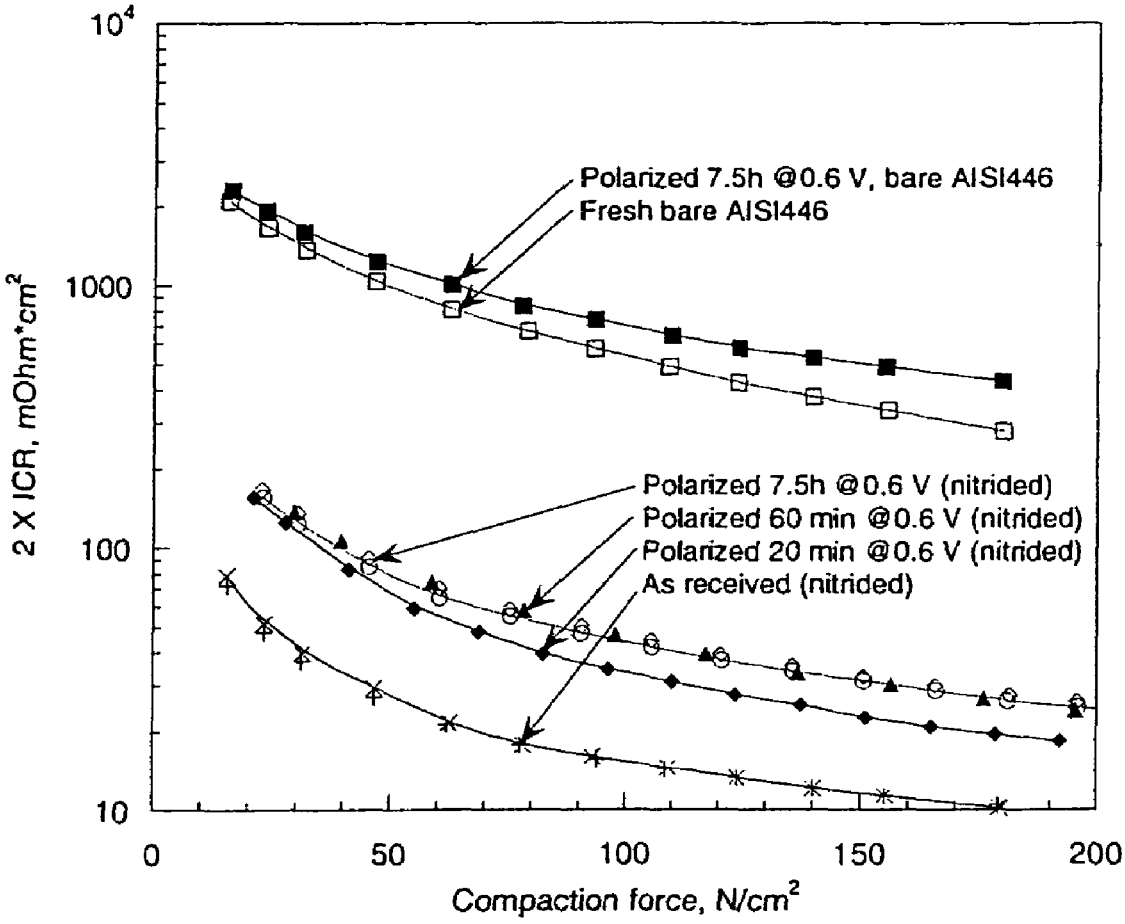
FIG. 5 is a graph showing a comparison of the influence of polarization in simulated PEMFC cathode environment on the interfacial contact resistance (ICR) of nitrided and un-nitrided 446. Note that the y-axis uses 2 times of ICR meaning that 2 interfaces are plotted altogether.

A significant, and highly beneficial effect of the 2 hour nitridation became apparent on examination of interfacial contact resistance (FIG. 5). Nitridation decreased the interfacial contact resistance (ICR) of AISI446 stainless steel by well over an order of magnitude. The effect was particularly evident at the low loads relevant to fuel cell stacks, in the range of 100-150 N/cm$^2$. Polarization under simulated cathodic conditions did raise the ICR of the 2 hour nitrided AISI446 stainless steel, which increased with time for the first hour of polarization in the air purged solution at 0.6 V, and then reaching a limiting value between 1-7.5 hours of polarization. Similar behavior trends of reaching a limiting value of ICR with a polarization time between 1-7.5 hours was also observed for untreated 349 stainless steel alloy under these same test conditions. However, the magnitude of the increased ICR for the nitrided AISI446 with polarization was small (×2), with the ICR levels remaining less than $40\times10^{-3}$ Ohm-cm$^2$ at a load of 150 N/cm$^2$. Therefore, the 2 hour 1100° C. nitridation treatment for AISI446 stainless steel modified the surface such that the ICR was significantly decreased, and, further, moderately improved on the already promising corrosion resistance of untreated AISI446 under the simulated PEMFC test conditions examined.

Figure 6:
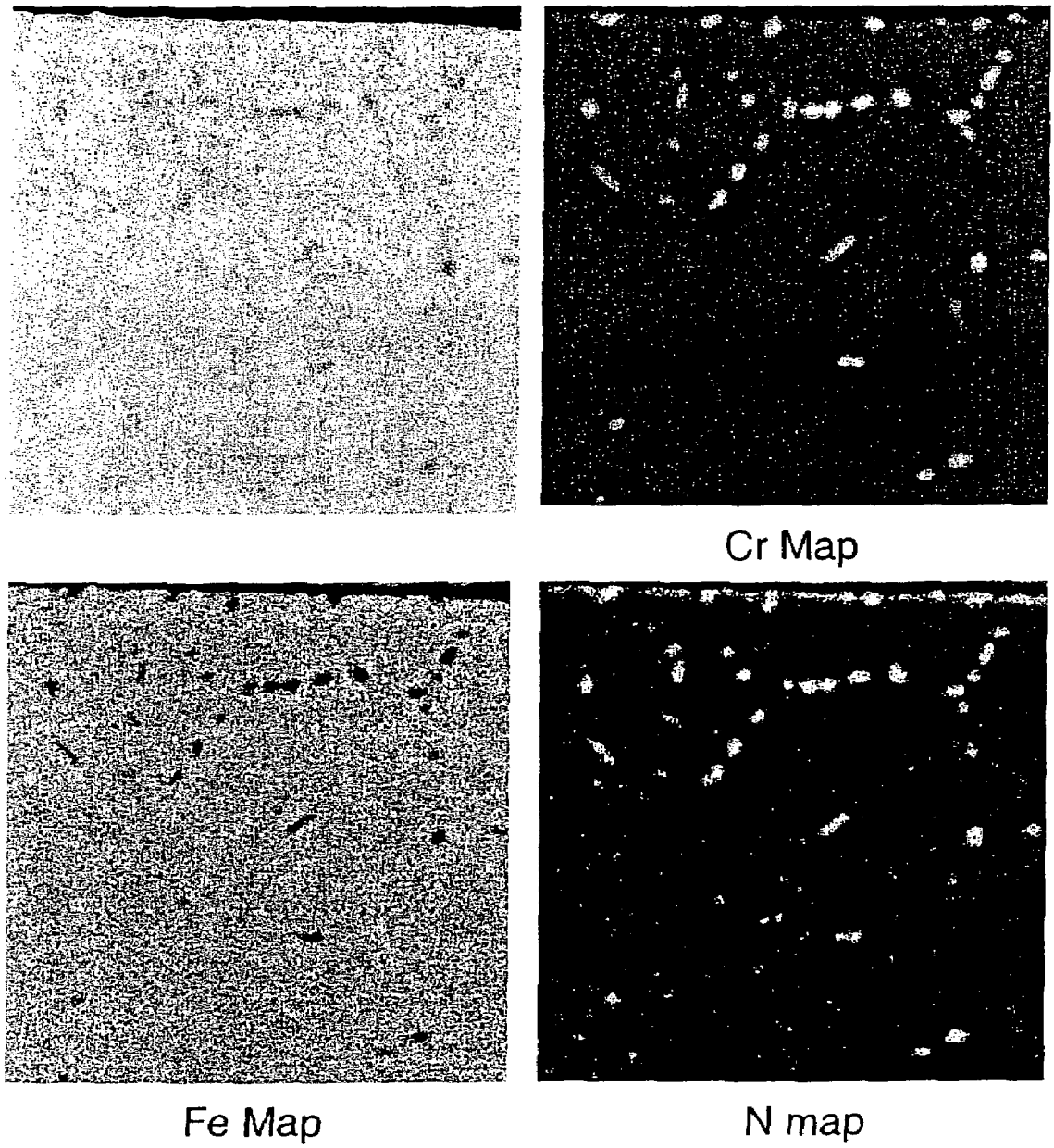
FIG. 6 includes photographs showing a SEM cross-section and elements mapping of 2 hour nitrided AISI446 steel.
Figure 7:
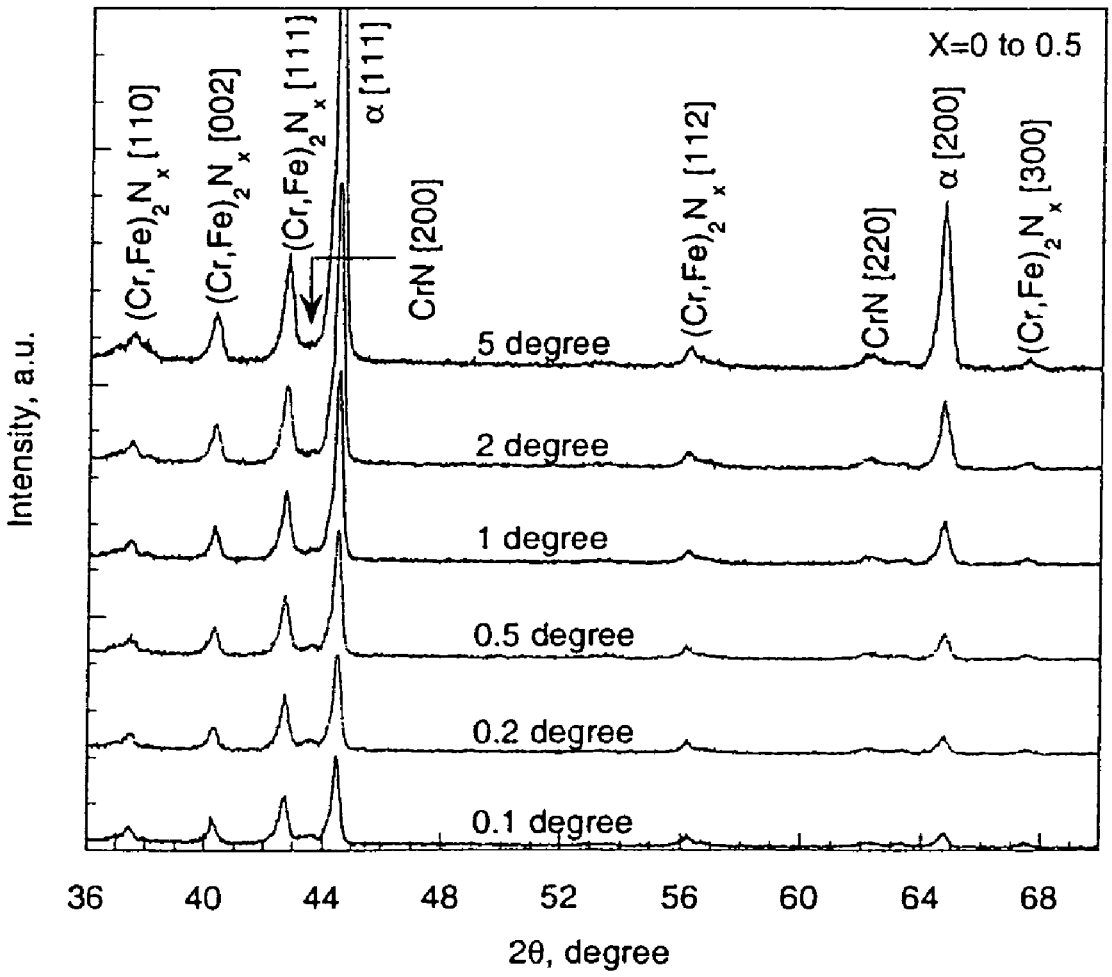
FIG. 7 is a graph showing glancing angle XRD pattern for 2 hour thermally nitrided AISI446 stainless steel.
Figure 8:
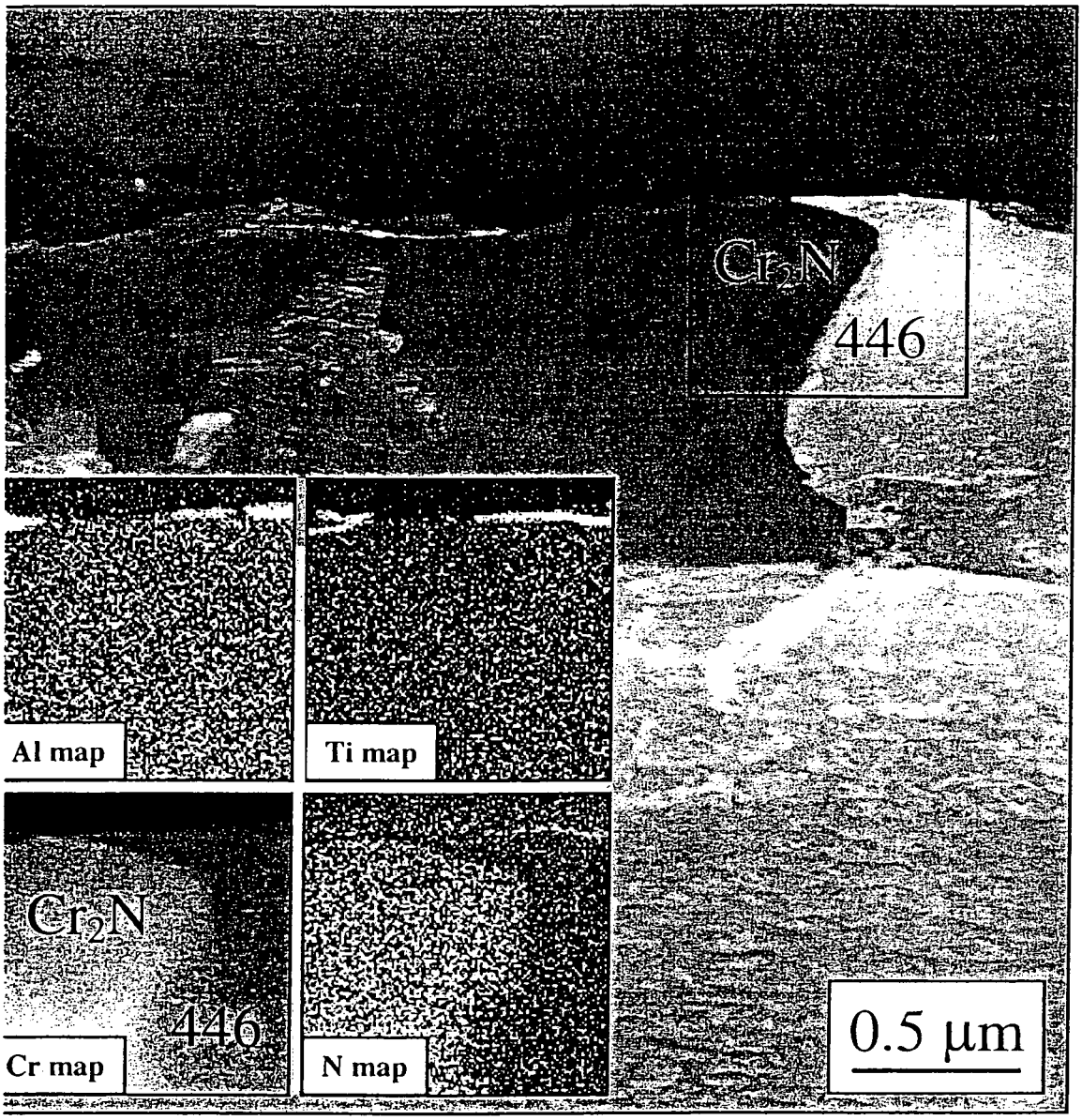
FIG. 8 includes photographs showing a TEM cross-section of the 2 hour nitrided AISI446 steel and the elements mapping.
Figure 9:
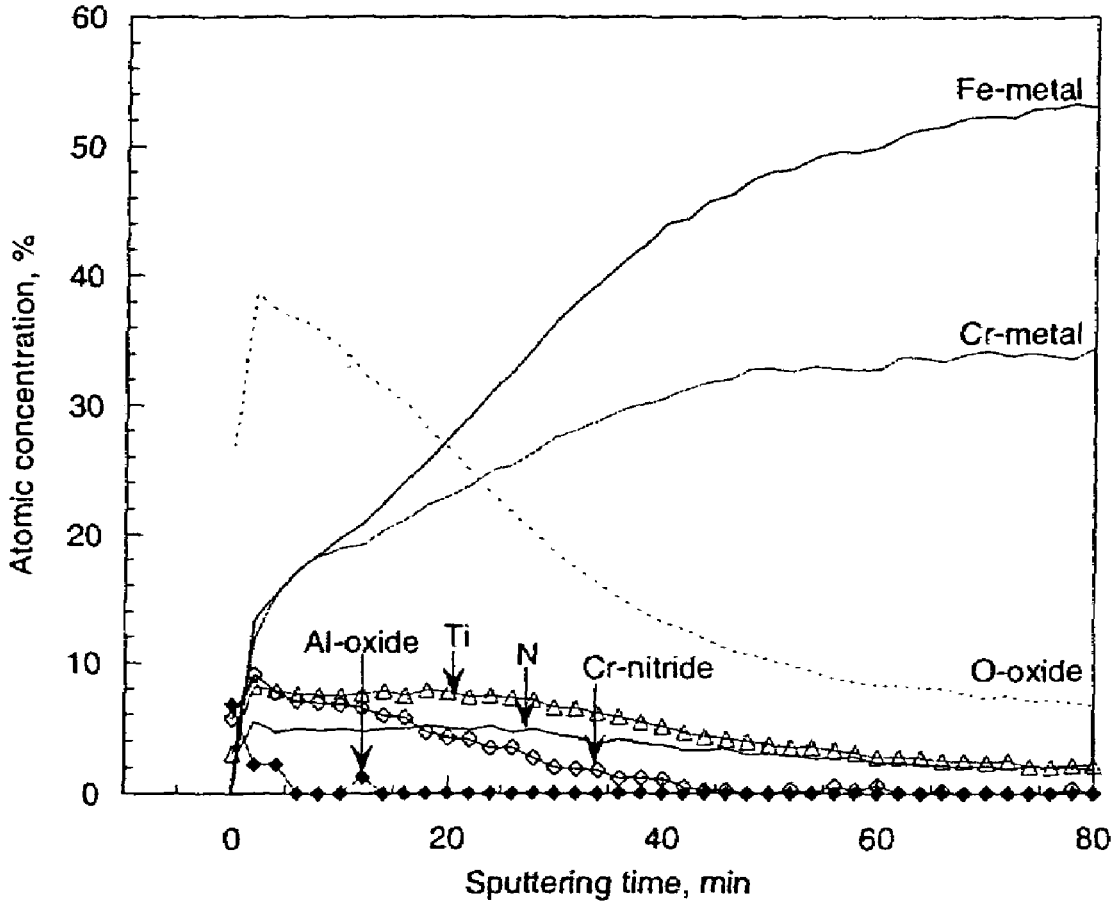
FIG. 9 is a graph showing an XPS depth profile of 2 hour nitrided AISI446 stainless steel.

Microstructural examination revealed that the 2 hour nitridation treatment yielded a different microstructure than either that produced by the 24 hour treatment (FIG. 2) or was observed in the nitrided Ni-50Cr model alloy (as described in U.S. patent application Ser. No. 2003/0190515). SEM cross-section analysis (FIG. 6) shows no evidence of a significant Cr-nitride surface layer and reveals only a minor amount of near-surface internal nitride precipitates. Glancing angle XRD (FIG. 7) indicates the presence primarily of ferrite, with minor amounts of $(Cr,Fe)_2N_{1-x}$ (x=0 to 0.5) and CrN. Cross-section TEM (FIG. 8) reveals isolated, inward growing surface grains on the order of 1 mm. deep consistent with $Cr_2N$ (or $(Cr,Fe)_2N_{1-x}$), and patches of a possibly semi-continuous surface layer over both Cr-nitride and ferrite regions on the order of 100 nm. thick that appeared to consist of distinct Al-oxide and Ti-nitride particles. XPS analysis (FIG. 9) is consistent with the microstructures observed in TEM, and suggested a near-surface region rich in Cr-nitrides, Ti-nitrides, Al-oxides, Fe metal and Cr metal. It is particularly interesting to note that the levels of oxygen detected at the surface were significantly higher than the levels of nitrogen. More detailed analysis by Auger suggested a very complex, chemically heterogeneous surface (with many alloy elements and impurities detected) rather than a uniform or semi-uniform surface layer exclusively rich in Al, Ti, or Cr.

Thus, the microstructural analysis of the 2 hour nitridation treatment revealed a heterogeneous surface that included isolated, discrete Cr-nitride grains less than 1 micron thick and a thin (<100 nanometers) semicontinuous overlayer of a mixture of aluminum oxide and titanium nitride. Effectively, the treatment modified the native passive layer on the 446 steel and segregated chromium, aluminum and titanium to the surface in forms that exhibit a low contact resistance and good corrosion resistance.

The data suggest that the 1100° C. 2 hour nitridation treatment for AISI446 resulted in a nitrogen modification of the native passive oxide layer on the alloy, which improved corrosion resistance in the aggressive simulated PEMFC anode and cathode environments, and significantly decreased ICR. Further, this surface modification proved resistant to significant ICR increase with polarization under passivating conditions. This is an entirely different surface modification phenomenon and effect than that observed for the nitriding of the model Ni-50Cr alloy (as described in U.S. patent application Ser. No. 2003/0190515), which resulted in a microns-thick exclusive and protective Cr-nitride surface layer.

Figure 10:
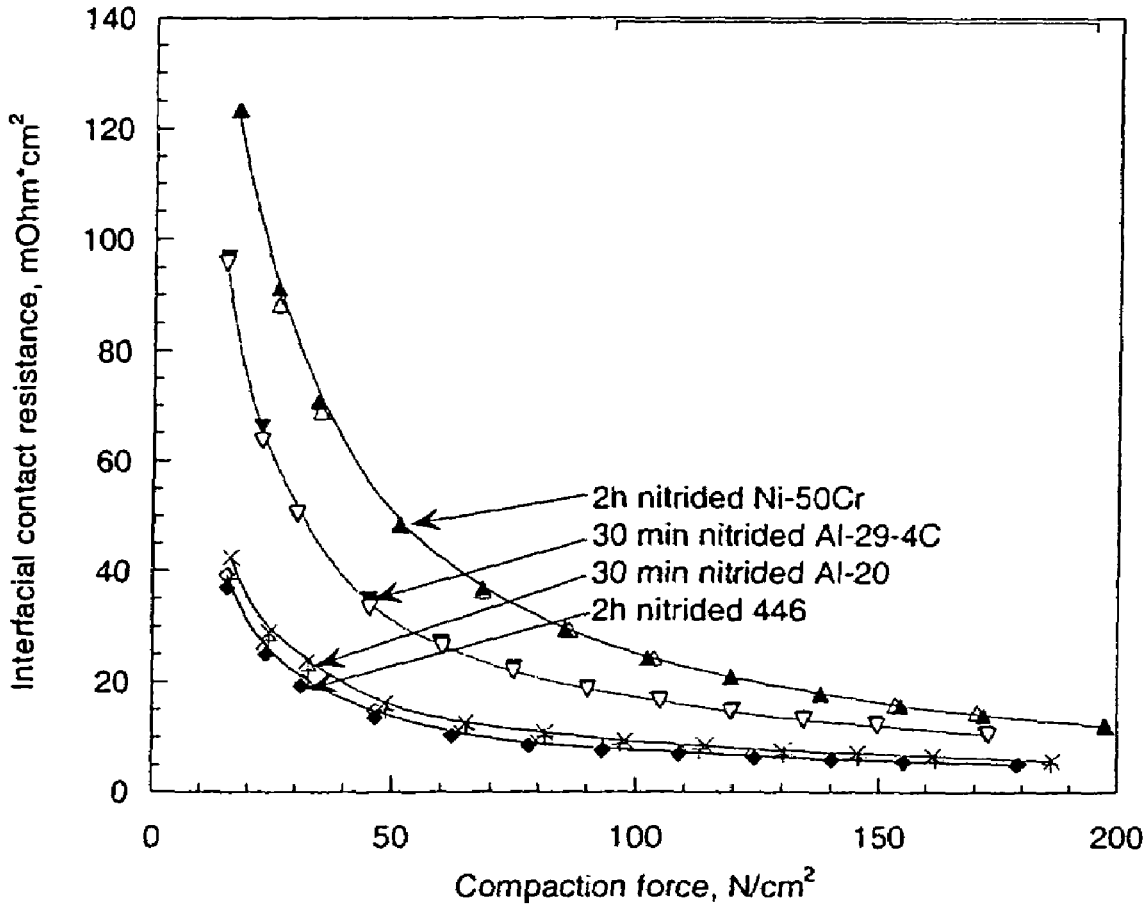
FIG. 10 is a graph showing interfacial contact resistance (ICR) values for different materials and with different treatment time in $N_2$ at 1100° C.

FIG. 10 shows that the ICR lowering nitridation treatment is amenable to alloys other than 446 mod 1, in this case Al-20™ and Al-29-4C® (commercially available Allegheny Ludlum stainless steel alloys). Al-20™ is an austenitic alloy and has a typical chemical composition in weight percent as follows: Carbon 0.02; Manganese 0.40; Phosphorus 0.025; Sulfur 0.002; Silicon 0.40; Nickel 33.00; Chromium 19.50; Molybdenum 2.15; Copper 3.20; Columbium+Tantalum 0.40; and Iron Balance. Al-29-4C® is a superferritic alloy and has a typical chemical composition in weight percent as follows: Carbon 0.02; Manganese 0.50; Phosphorus 0.03; Sulfur<0.01; Silicon 0.35; Chromium 29; Nickel 0.30; Molybdenum 4; Nitrogen 0.02; Titanium+Columbium (Niobium) 0.6; and Iron Balance. The data is shown in FIG. 10 in reference to the dense Cr-nitride layer formed on a model Ni-50Cr alloy as described in U.S. 2003/0190515.

Studies performed with AL 29-4C® and 446 MOD-1 indicated similar low corrosion rates and low ICR values to that obtained at 1100° C./2 h/pure $N_2$ for nitriding treatments in the 800-900° C. temperature/24-48 hour range in $N_2$-$4H_2$ environments (weight changes after nitridation in the 0.2-0.7 mg/cm$^2$ range).

Control of oxygen impurities and, in $N_2$—$H_2$ mixtures, hydrogen level, especially with regards to excessive oxidation or reduction of the initial passive oxide scale in the nitriding environment also must be considered. For example, using bottled $N_2$-$4H_2$ at 1100° C., a 2 hour treatment for 446 MOD-1 yielded undesirable high interfacial contact electrical resistance despite a target range weight change of 0.2 mg/cm$^2$. This was found to be the result of excessive oxidation during the nitriding treatment, with the formation of a thick oxide layer. Therefore, the extent of oxygen impurities in the $N_2$ and $N_2$—$H_2$ nitriding environments can significantly effect the desired surface layer formation.

Accordingly, the use of nitridation conditions that do not result in significant interaction with the stainless steel alloy/internal Cr-nitride precipitation, yet permit modification of the passive layer with nitrogen are preferred. Without intending to be bound by theory, it is believed that a contributor to the good behavior was the presence of titanium and/or aluminum in the alloy and subsequent segregation to the surface layer. It is believed that chromium levels of 20 wt. % or greater may also limit the extent to which iron is involved in the nitriding reaction. These suggest similar microalloying of other stainless steel alloys and selection of low reactivity nitridation conditions for that steel by control of temperature and time.

Thus, the invention provides a nitridation surface treatment that modifies the passive oxide layer on stainless steel alloys such that the interfacial electrical contact resistance is decreased and the corrosion resistance is improved. Stainless steel alloys processed in accordance with the invention are useful in electrochemical energy conversion devices that require low contact resistance and good corrosion resistance, such as the bipolar plates used in proton exchange membrane fuel cells or similar components in related electrochemical devices (direct methanol fuel cells, batteries, sensors, electrolyzers, etc.).

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. An article comprising:

stainless steel having a surface layer including nitrogen-modified chromium-base oxide and precipitates of chromium nitride, wherein oxygen is present in the surface layer at a greater concentration than nitrogen, wherein the article includes surface grains of precipitates of chromium nitride.

2. The article of claim 1 wherein:

the surface layer is 1 micron thick or less.

3. The article of claim 1 wherein:

the surface layer is 100 nanometers thick or less.

4. The article of claim 1 wherein:

the surface layer further includes precipitates of titanium nitride, and the nitrogen-modified chromium-base oxide is present in the surface layer at a greater concentration than the precipitates of chromium nitride and the precipitates of titanium nitride combined.

5. The article of claim 4 wherein:

the surface layer further includes precipitates of aluminum oxide, and the nitrogen-modified chromium-base oxide and the precipitates of aluminum oxide are present in the surface layer at a greater concentration than the precipitates of chromium nitride and the precipitates of titanium nitride combined.

6. The article of claim 1 wherein:

the surface layer further includes precipitates of a transition metal nitride.

7. The article of claim 1 wherein:

the stainless steel comprises nickel at a level of less than 5 weight percent based on the total weight of the stainless steel.

8. The article of claim 7 wherein:

the stainless steel is ferritic.

9. The article of claim 1 wherein:

the stainless steel comprises greater than 20 weight percent nickel based on the total weight of the stainless steel.

10. The article of claim 9 wherein:

the stainless steel is austenitic.

11. The article of claim 1 wherein:

the stainless steel comprises titanium at a level of 1 weight percent or less based on the total weight of the stainless steel.

12. The article of claim 1 wherein:

the surface layer is a chemically heterogeneous surface and not a uniform or semi-uniform surface layer exclusively rich in chromium.

13. A proton exchange membrane fuel cell comprising the article of claim 1 as a bipolar plate.

14. A sensor comprising the article of claim 1 as a bipolar plate.

15. A process for increasing the corrosion resistance and decreasing the interfacial contact electrical resistance of a stainless steel article, the process comprising:

(a) providing an article comprising stainless steel having a surface layer including chromium-base oxide;

(b) exposing the surface layer to an atmosphere comprising nitrogen without prior removal of the surface layer to introduce nitrogen into the chromium-base oxide and to form precipitates of chromium nitride in the surface layer; and (c) ceasing exposure of the surface layer to the atmosphere before the volume of precipitates of chromium nitride degrades the corrosion resistance.

16. The process of claim 15 wherein:

the atmosphere consists of nitrogen or a nitrogen-hydrogen mixture.

17. The process of claim 15 wherein:

the atmosphere is free from oxygen.

18. The process of claim 15 wherein:

step (b) is conducted at a temperature in the range of 800° C. to 1200° C.

19. The process of claim 15 wherein:

step (c) comprises ceasing exposure of the surface layer to the atmosphere when nitrogen uptake for the surface layer exceeds 1 $mg/cm^2$.

20. The process of claim 15 wherein:

step (c) comprises ceasing exposure of the surface layer to the atmosphere when nitrogen uptake for the surface layer is in the range of 0.05 $mg/cm^2$ to 0.75 $mg/cm^2$.

21. The process of claim 15 wherein:

step (c) comprises ceasing exposure of the surface layer to the atmosphere when nitrogen uptake for the surface layer is in the range of 0.25 $mg/cm^2$ to 0.5 $mg/cm^2$.

22. The process of claim 15 wherein:

nitrogen modified chromium-base oxide is present in the surface layer at a greater concentration than the precipitates of chromium nitride in the surface layer after ceasing exposure of the surface layer to the atmosphere.

23. The process of claim 15 wherein:

the stainless steel comprises titanium at a level of 1 weight percent or less based on the total weight of the stainless steel, and the surface layer includes precipitates of titanium nitride after exposing the surface layer to the atmosphere.

24. The process of claim 23 wherein:

the surface layer further includes precipitates of aluminum oxide after exposing the surface layer to the atmosphere, and chromium-base oxide and the precipitates of aluminum oxide are present in the surface layer at a greater concentration than the precipitates of chromium nitride and the precipitates of titanium nitride combined.

25. The process of claim 15 wherein:

the interfacial contact electrical resistance of the article is 50 $milliohms/cm^2$ or less at a contact force of 100-150 $N/cm^2$ after ceasing exposure of the surface layer to the atmosphere.

26. The process of claim 15 wherein:

the interfacial contact electrical resistance of the article is 30 $milliohms/cm^2$ or less at a contact force of 150 $N/cm^2$ after ceasing exposure of the surface layer to the atmosphere.

27. The process of claim 15 wherein:

the interfacial contact electrical resistance of the article is 20 $milliohms/cm^2$ or less at a contact force of 150 $N/cm^2$ after ceasing exposure of the surface layer to the atmosphere.

28. The process of claim 15 wherein:

oxygen is present in the surface layer at a greater concentration than nitrogen after ceasing exposure of the surface layer to the atmosphere.

29. The process of claim 15 wherein:

the article is a bipolar plate of a fuel cell.

30. The process of claim 15 wherein:

the article is a bipolar plate of a sensor.

31. A proton exchange membrane fuel cell comprising:

a bipolar plate comprising stainless steel having a surface layer including nitrogen-modified chromium-base oxide and precipitates of chromium nitride, wherein oxygen is present in the surface layer at a greater concentration than nitrogen.

32. The proton exchange membrane fuel cell of claim 31 wherein:

the surface layer is 1 micron thick or less.

33. The proton exchange membrane fuel cell of claim 31 wherein:

the surface layer further includes precipitates of titanium nitride, and the nitrogen-modified chromium-base oxide is present in the surface layer at a greater concentration than the precipitates of chromium nitride and the precipitates of titanium nitride combined.

34. The proton exchange membrane fuel cell of claim 31 wherein:

the surface layer further includes precipitates of aluminum oxide, and the nitrogen-modified chromium-base oxide and the precipitates of aluminum oxide are present in the surface layer at a greater concentration than the precipitates of chromium nitride and the precipitates of titanium nitride combined.

35. The proton exchange membrane fuel cell of claim 31 wherein:

the stainless steel comprises nickel at a level of less than 5 weight percent based on the total weight of the stainless steel.

36. The proton exchange membrane fuel cell of claim 31 wherein:

the stainless steel comprises greater than 20 weight percent nickel based on the total weight of the stainless steel.

37. A sensor comprising:

a bipolar plate comprising stainless steel having a surface layer including nitrogen-modified chromium-base oxide and precipitates of chromium nitride, wherein oxygen is present in the surface layer at a greater concentration than nitrogen.

38. The sensor of claim 37 wherein:

the surface layer is 1 micron thick or less.

39. The sensor of claim 37 wherein:

the surface layer further includes precipitates of titanium nitride, and the nitrogen-modified chromium-base oxide is present in the surface layer at a greater concentration than the precipitates of chromium nitride and the precipitates of titanium nitride combined.

40. The sensor of claim 37 wherein:

the surface layer further includes precipitates of aluminum oxide, and the nitrogen-modified chromium-base oxide and the precipitates of aluminum oxide are present in the surface layer at a greater concentration than the precipitates of chromium nitride and the precipitates of titanium nitride combined.

41. The sensor of claim 37 wherein:

the stainless steel comprises nickel at a level of less than 5 weight percent based on the total weight of the stainless steel.

42. The sensor of claim 37 wherein:

the stainless steel comprises greater than 20 weight percent nickel based on the total weight of the stainless steel.

* * * * *